US008881747B2

(12) United States Patent
Dietze

(10) Patent No.: US 8,881,747 B2
(45) Date of Patent: Nov. 11, 2014

(54) METHOD FOR PRODUCING HOODS AND ARRANGEMENT OF A PLURALITY OF HOODS

(75) Inventor: Matthias Dietze, Helmstedt (DE)

(73) Assignee: Solida AG (CH)

( * ) Notice: Subject to any disclaimer, the term of this patent is extended or adjusted under 35 U.S.C. 154(b) by 208 days.

(21) Appl. No.: 13/255,138

(22) PCT Filed: Mar. 15, 2010

(86) PCT No.: PCT/EP2010/053263
§ 371 (c)(1),
(2), (4) Date: Oct. 24, 2011

(87) PCT Pub. No.: WO2010/106010
PCT Pub. Date: Sep. 23, 2010

(65) Prior Publication Data

US 2012/0132227 A1 May 31, 2012

(30) Foreign Application Priority Data

Mar. 17, 2009 (DE) ..... 10 2009 013 192

(51) Int. Cl.
*A45D 8/40* (2006.01)
*D04B 1/12* (2006.01)

(52) U.S. Cl.
CPC ... *A45D 8/40* (2013.01); *D04B 1/12* (2013.01)
USPC ..... 132/274; 66/170

(58) Field of Classification Search
USPC ..... 132/53–56, 201, 270, 274; 428/304, 428/310, 906; 2/125, 270, 197; 66/195
See application file for complete search history.

(56) References Cited

U.S. PATENT DOCUMENTS 1,879,362 A 9/1932 Lipper
2,329,676 A 9/1943 Henry
2,524,255 A 10/1950 Goldsmith
(Continued)

FOREIGN PATENT DOCUMENTS

DE 1 359 645 11/1935
DE 1 457 412 1/1969
(Continued)

*Primary Examiner* — Robyn Doan
(74) *Attorney, Agent, or Firm* — Salter & Michaelson

(57) ABSTRACT

The invention relates to a method for producing hoods in the form of hair nets having meshes, creating hoods having a first dimension over the head from front to rear and a second dimension crosswise thereto. A strand (20) of a net having a mesh (23) is created from threads (21). The strand (20) has two longitudinal sides. The number of meshes (23) of the net crosswise to the longitudinal sides corresponds to the number of meshes (11) of the hair net to be produced along the first or second dimension of the hair net. On or neighboring the two longitudinal sides of the strand (20), one elastic thread (22) each is fed into the outer meshes (23) of the net. At specified, regular distances, the two elastic threads (22) are guided together and connected to one another. The distance is chosen such that the number of meshes (23) of the net between two connection points (24) in the longitudinal direction of the strand (20) corresponds to the number of meshes (11) of the hair net to be produced along the first or second dimension of the hair net. The two elastic threads (22) are connected by joining to one another by means of a sealing and/or melting process. A weakness (25) is introduced in the connection region (24).

9 Claims, 2 Drawing Sheets

(56) References Cited

U.S. PATENT DOCUMENTS

| | | | | |
|---|---|---|---|---|
| 2,638,102 | A | 5/1953 | Goldsmith | |
| 2,686,348 | A | 8/1954 | Goldsmith | |
| 4,289,150 | A * | 9/1981 | Kimball | 132/270 |
| 2005/0259893 | A1 | 11/2005 | Chen | |

FOREIGN PATENT DOCUMENTS

| | | |
|---|---|---|
| DE | 1 812 345 | 7/1969 |
| DE | 2 210 259 | 9/1973 |
| DE | 24 16 375 | 10/1975 |
| DE | 24 45 925 | 4/1976 |
| DE | 24 61 881 | 7/1976 |
| DE | 10 2009 013 192 | 9/2010 |
| EP | 0 587 361 | 3/1994 |
| EP | 0 823 376 | 2/1998 |
| EP | 1 967 459 | 9/2008 |
| FR | 1 295 792 | 6/1962 |
| FR | 1 314 693 | 1/1963 |
| FR | 1 405 461 | 7/1965 |
| GB | 1903 21396 | 11/1903 |
| GB | 554 606 | 7/1943 |

* cited by examiner

METHOD FOR PRODUCING HOODS AND ARRANGEMENT OF A PLURALITY OF HOODS

TECHNICAL FIELD

The invention relates to a method for producing hoods in the form of hair nets having meshes, wherein the hood has a first dimension over the head from front to back and a second dimension crosswise thereto, in which a strand of a net having meshes is produced from threads, in which the strand has two longitudinal sides, in which the number of meshes of the net crosswise to the longitudinal sides corresponds to the number of meshes of the hair net to be produced along the first or the second dimension of the hair net, in which on or adjacent to the two longitudinal sides of the strand, an elastic thread in each case is fed into the outer meshes of the net, in which both elastic threads are guided together and joined to one another at predetermined regular distances, wherein this distance is selected such that the number of meshes of the net between two joining points in the longitudinal direction of the strand corresponds to the number of meshes of the hair net to be produced along the second or the first dimension of the hair net, wherein both elastic threads are joined together with the other threads by joining by means of a bonding and/or melting process.

The invention also relates to an arrangement of a plurality of hoods.

BACKGROUND OF THE INVENTION

A very large number of hoods are required daily throughout the world. While earlier, they were used primarily for private purposes for protection of hairstyles, today there is predominantly a commercial use, for example in the food industry or in the manufacture of electronic components. In handling and packaging foods as well as in processing electronic components, such as, for example chips, printed circuit boards and similar products in clean rooms or ultraclean rooms, an essential condition is that hairs of the worker do not enter the production cycle, thus will not be packaged or will not be processed in any form with the foods or, in the case of electronic components, will not interfere in the manufacture thereof nor adversely affect the function of the end products.

For this reason, the employees in these enterprises that are occupied directly with the processing, manufacture, or packaging of these products wear hoods, which, on the one hand, prevent undesired contaminations or adverse effects on the products due to hairs, and, on the other hand, also protect and hold the hairstyles and hairdos of the persons involved.

For hygienic and also for practical reasons, in most cases, hoods for one-time use are involved, which the workers put on at the beginning of the work shift and discard at the end of the work shift.

This has as a consequence that, on the one hand, the cost for such hoods must be set extraordinarily low, since the considerable number of hoods required can also be correspondingly should a relevant cost factor in the respective enterprise. On the other hand, of course, there is also an interest in the fact that the hoods kept in stock correspondingly take up little space in the rooms required therefor and that for environmental reasons and with consequent consideration also with respect to the costs of disposal, it is absolutely necessary to no longer deal with large quantities of waste that must be disposed of.

Thus, hoods in the form of hair nets have proven particularly suitable and are widely used throughout the world.

Hoods in the form of hair nets are known, for example, from DE 18 12 345 U1, DE 24 16 375 A1 and DE 24 61 881 A1. They comprise a plurality of meshes of a net. In the outer meshes of the net, in this case, an elastic thread is integrated in the finished hood, running around the periphery thereof, this thread holding the hood on the head of the wearer. Seen from the front over the head to the back, on the one hand, and seen over the head from left to right, on the other hand, the number of meshes is of approximately the same order of magnitude, but need not be completely identical.

The production of hoods is automated as much as possible, for cost reasons. Production is carried out by continuous generation of a mesh net on so-called Raschel machines. Two additional elastic threads are fed onto the outer paths or longitudinal sides of the produced strand of the mesh net on these Raschel machines. The strand that is formed with the two elastic threads adjacent to the outer longitudinal sides is rolled up, so that a very large roll of relatively continuous material if formed.

Individual hair nets or hoods are then produced from this strand. In this regard, the proposal has been set forth in DE 14 57 412 A1 to automatically collect a certain length of the strand during its formation after this length has been obtained, and to separate it by a brief heat shock of a bonding air jet of a plastic bonding torch and to bond the separated end with the formation of a small bonding bead.

This procedure, however, has not succeeded in practice due to technical difficulties.

Conventionally, rolls with the strands that have still not been separated into hoods in this way are then transferred to another processing site, where a length of the produced strand is removed manually each time from this roll by workers, this length corresponding approximately to the diameter of the hood to be produced. The two elastic threads are then knotted at the end of the strand provided for the hood. Subsequently, the two threads are again knotted at the other end of the strand provided for the hood and in this way all threads of the net lying in between are also collected. Then, seen from behind this second knot, [the hair net] is cut off from the end of the strand, and the two elastic threads as well as the threads of the hair net are now separated. After this, another knot is introduced on the end of the remaining strand, and the procedure is repeated. The individual hair nets that are formed in this way thus possess the mentioned threads running around [the outer periphery], which technically comprise two threads, each of which surrounds one-half of the hood, and these are knotted or sewn to together.

Each of the hoods manufactured in this way is then folded together and usually placed between a folded piece of tissue paper. A plurality of these tissue paper sheets, each of which is provided with a hood, is then made up into a package. Approximately 144 of these pieces of tissue paper, each containing a hood, are usually disposed in one sales unit.

The single packaging is necessary so that each time the user can rapidly remove a hood that he/she requires, with little lost time. In view of the structure of nets, a packaging of a plurality of unseparated hoods is not expedient, since these would be found inside one another and would be difficult to separate and to isolate manually, and thus one must take into consideration a considerable loss of unusable hoods that are tangled up inside one another.

The packaging of individual hoods in pieces of tissue paper is very labor-intensive and thus also a cost factor, which contributes considerably to the total costs for such otherwise inexpensive articles.

Another problem arises for the users who must dispose of the tissue paper, which is annoying in locker rooms given the haste in donning and removing the hoods and also leads to a considerable amount of tissue paper waste.

In view of the considerable quantities of hoods and thus the considerable amount of tissue paper that is used for this purpose, the weight of the tissue paper that is used is also another disruptive factor in transport and disposal.

It would be desirable if there were possibilities for the production or the transport or even for the type of structure of hoods that would lead to a reduction in labor expenditure or also to a reduction of the other problems.

The problem of the invention is thus to propose a method with which a different type of production of hoods is made possible.

SUMMARY OF THE INVENTION

This problem is solved according to the invention by a method of this generic type by introducing a weakness in the joining region.

An essentially simplified and automated production and, in addition to this, an improved accommodation of the hoods in modified packaging is also surprisingly made possible with such a method.

The labor-intensive knotting of the elastic edge threads of the strand is completely eliminated. Instead of this, the elastic edge threads are, in particular, bonded with one another. For this purpose, a point input of heat into a joining region is offered, this region being formed by bringing together the two elastic threads. An ultrasonic bonding is conceivable, for example.

In this bonding process, not only are the two elastic edge threads bonded with one another, but also all threads of the net between these two threads are bonded. This means that the entire strand is bonded together as a whole over this short segment length.

The practical problems still existing in the case of the original concept according to DE 14 57 412 A1 can be reduced to a considerable degree by such ultrasonic bonding.

Of course, this ultrasonic bonding or this other bonding process alone still does not solve the problem of the invention.

This bonding process can be carried out automatically, since the number of meshes is known in advance and such a bonding or melting process can be provided also at intervals during production when the strand is formed. The round or ring-shaped desired shape of these elastic edge threads is formed automatically in this way.

This region that is bonded together or which arises through the bonding process thus forms the end of one hood and at the same time the beginning of the next hood.

Between the end of one hood and the beginning of the next hood, however, no cutting off or separating is conducted in this bonding process, unlike in DE 14 57 412 A1. Instead of this, one now applies a type of preliminary separation site for later use between the end of one hood and the beginning of the next hood. A weakness in the joining region is introduced for this.

This weakness is appropriately provided crosswise to the longitudinal direction of the strand. The provision of a perforation with one or more perforation holes or perforation regions is preferably considered for this.

Alternatively, a type of predetermined breaking site between the end of one hood and the beginning of the next hood can also be produced precisely in this joining region of the two elastic threads by an appropriate impressing of a constriction.

An actual separating of the two hoods at this weakness is not carried out at this time. The fact can now be used advantageously that by bonding or melting and subsequently introducing the weakness, the strand made up of the net containing meshes and the two elastic threads has become a strand made up of a plurality of largely finished hoods, which are still joined together only at the joining regions containing the respective weakness. This series of hoods can now be used as a ready-to-sell product. For this purpose, this strand or this series of hoods is either rolled up again or, however, combined in an accordion shape or made into another shape in compact form from the strand or series.

A completely novel product, namely an arrangement of a plurality of hoods, is thus formed by the method, in which all hoods of the plurality of hoods have two common elastic threads that pass through them, which, in each of the hoods, pass through meshes in the peripheral region of the respective hood, in which all hoods of the plurality of hoods hang together in a chain form, in which every two hoods of the plurality of hoods that hang together in a chain form are combined at a joining region, in which the joining region is formed by a melting or bonding process of the two elastic threads with one another, and in which the joining region has a weakness between every two hoods.

Arrangements of a plurality of hoods previously existed only in the form described initially, as a sales unit containing numerous individually packed hoods. The invention now creates an arrangement made up of a plurality of hoods that hang together and that are sold as a whole, and in fact without individual packaging and based on the pre-defined type of chain structure that does not have a significant risk of becoming tangled.

The consumer would receive this finished sales unit comprising the plurality of hoods without additional intermediate layers of tissue paper separating the hoods and could then carry out himself the final separation of a hood that is necessary each time.

Appropriate dispensing packages are offered for this purpose, whereby the user takes a hood and separates it from the next hood at the pre-determined breaking site each time, just like for endless rolls of paper or also for household foils.

This breaking site can be provided both by means of perforations as well as by tear-off edges.

The concept functions particularly well, if a covered thread is used as the material for the elastic threads. In particular, a covered elastic thread has proven suitable, which preferably has a core of an elastane, thus a polyurethane urea, for example, an elastane marketed under the tradename Lycra, which is covered by a polyamide thread. An ultrasonic bonding process can be particularly well performed with these materials, a process that is predictable and makes possible a continuous, automatic processing without significant [manual] intervention.

A polyamide or a polypropylene is preferably used for the threads that form the net structure with their meshes and individual threads.

In selecting the appropriate materials, it has proven meaningful to take into consideration the temperature loads that occur during the bonding process. A material such as polyamide can thus be melted and bonded very well without being destroyed, while in contrast, the structure of elastane threads is attacked when a specific temperature is exceeded and are destroyed under certain circumstances. This means that at the least it can lose its elasticity due to the bonding process.

Therefore, it has resulted in preferably taking into consideration one of the following three variants in the selection of materials for the net structure and the edge threads:

In the first case, an elastane is selected that possesses a melting point that is as high as possible, particularly a temperature that is as distant as possible from the melting point of the material used for the net structure, thus, for example, of the polyamide used, which is used, on the one hand, for the covering of the elastane and, on the other hand, also for the net structure.

In this case, the bonding process will be conducted at a temperature at which the polyamide melts, while in contrast, the elastane is not yet attacked. After the bonding process, the edge threads and the net structure are then bonded together in the desired region, but the edge threads themselves are fed elastically unchanged through the bonding site which they contact directly. This means that the hood that is formed is surrounded by a guiding elastic thread, even if it comprises two segment parts.

In the second case, an elastane or another elastic thread is commonly used as previously, but a material having a melting point that is clearly reduced when compared with polyamide is used for the covering of this elastic thread and for the net structure.

Here, the same effect is utilized and the bonding process is then conducted in a temperature region that lies between the reduced melting point of the material of the net structure and of the covering, and the melting point of the elastic thread.

The same advantages as in the first case are obtained thereby.

As it has turned out, the temperature difference between the melting points of the material for the net structure, on the one hand, and the material for the core threads of the elastic threads, on the other hand, should amount to at least 10° C. and as much as possible to 30° C. or more. This has the advantage that a certain tolerance for the melting process is achieved.

In the third case, a thermoplastically formed polyamide is used instead for the edge threads. For this purpose, a polyamide thread is coiled in spiral form, for example, and then fixed in this form. The term "textured" is also commonly used for this. A polyamide thread of this type that is coiled into a spiral is also elastic due to its spiral shape. It is then no longer covered. A polyamide in conventional form is also used for the net structure.

These two materials can be bonded without problem and without damaging or destroying the structure. In this way, there arises a closed edge thread of polyamide, which is not in spiral shape and thus not elastic, only for a short length in the region of the two bonding sites, but this does not adversely affect the elasticity of the overall hood.

In all three variants, the weakness in the bonding region is made possible, for example, by a perforation without anything further, and does not adversely affect the workability of the strand with the plurality of hoods that is formed.

The complete absence of tissue paper in the packaging of the hoods is an enormous advantage also from an environmental point of view. First of all, this paper need not be produced and inserted, nor does it need to be disposed of after removing a hood to be used, so that it benefits the environment equally in two ways.

In spite of this, no more material than previously used is required for the hood itself. In addition, the labor-intensive process of knotting the elastic threads is omitted, being replaced by an automated bonding process. This bonding process also has the advantage that hygienic measures can be omitted during the knotting process, since as much as possible, in the knotting process also, no human traces will be found on the hoods except prehaps in the periphery.

DESCRIPTION OF THE DRAWINGS

An example of embodiment of the invention will be described in more detail below on the basis of the drawing. Herein.

DETAILED DESCRIPTION

Figure 1:
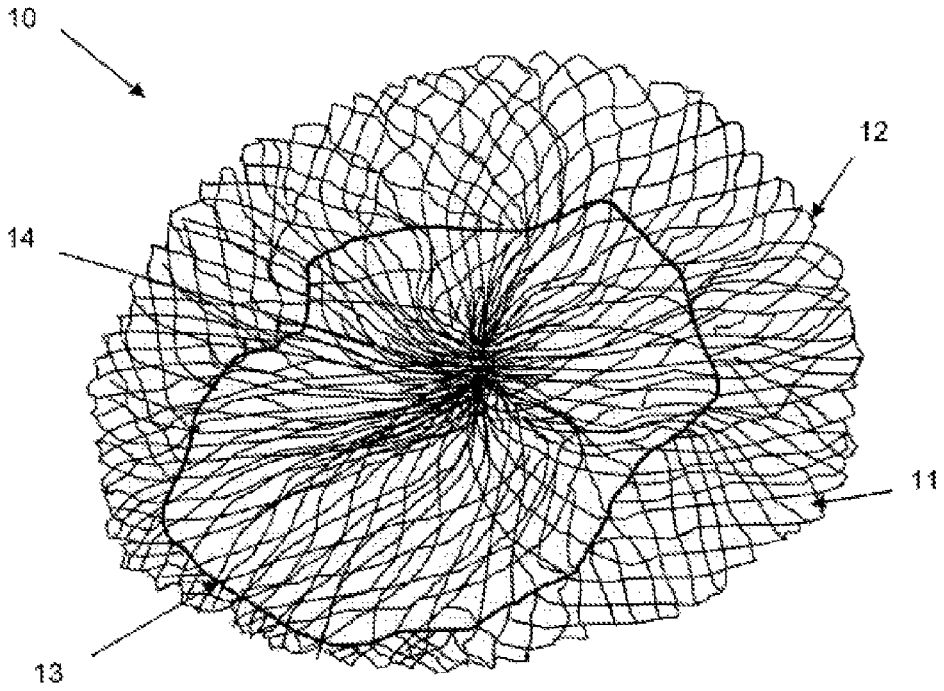
FIG. 1 shows a hood in an exemplary shape, viewed from the direction of its opening used for donning it.

A hood 10, as it is shown in exemplary form in FIG. 1, has a plurality of meshes 11. These meshes 11 are formed by threads 12.

Threads 12 with meshes 11 together form a net. Meshes 11 of the net are wide enough that the hair is held back and at the same time a hairstyle is also maintained without pressing or adversely affecting the hair more than absolutely necessary.

The net made up of threads 12 and meshes 11 can form a hood 10, and one or more elastic edge threads 13 is (are) provided. These elastic edge threads 13 surround an opening 14 of hood 10. The elastic edge threads 13 are fed into the outer edge meshes of the hair net made up of meshes 11 and belong there so that after the hood 10 is placed tightly on a human head, opening 14 does not slip and the hood is not accidentally pulled off. At the same time, the elastic edge threads 13 are dimensioned in their elasticity, so that wearing the hood 10 is not uncomfortable for the person wearing it.

Figure 2:
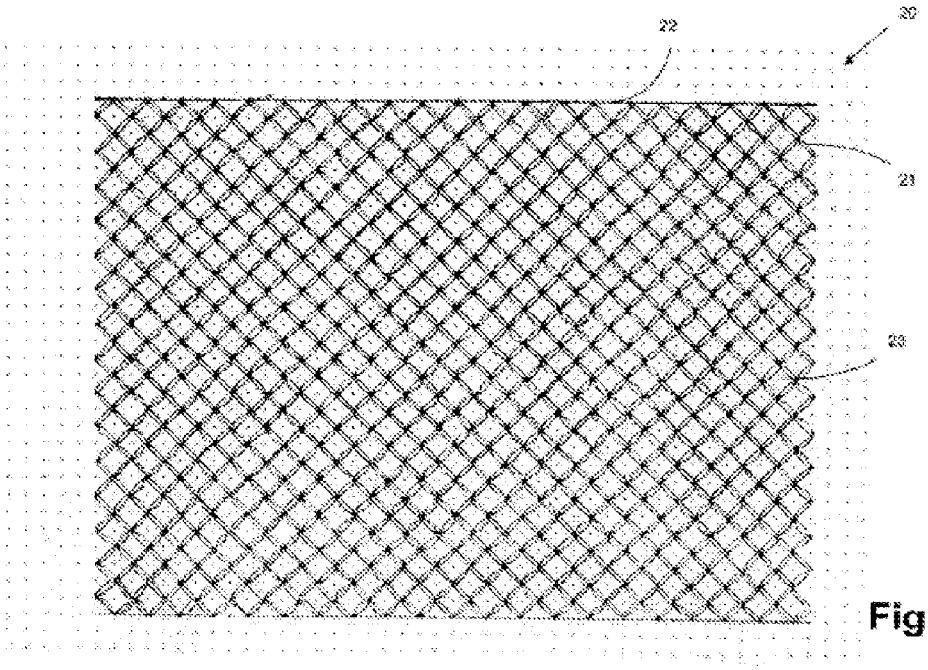
FIG. 2 shows a top view onto an excerpt of a series of nets or a strand directly after its formation prior to further processing to hoods.

The hoods 10 are manufactured in the form of hair nets from a strand 20, which is illustrated in FIG. 2. This strand 20 is constructed from a plurality of individual threads 21, which form meshes 23 in between. The threads are continually combined with one another in zigzag lines automatically and according to a complicated system.

The lengthwise extension of this strand 20 that is shown is endless, while the series of nets or strand 20 in the crosswise direction has as many meshes 22 as are required for one of the dimensions of hood 10 from FIG. 1 that is to be produced.

Strand 20 is limited by two longitudinal sides. Two edge threads 22 are integrated into meshes 23 of the strand adjacent to these longitudinal sides. These edge threads 22 are elastic threads made of a covered rubber. The core of these edge threads comprises Lycra, whereby this core is covered by a polyamide thread. The desired elasticity is formed thereby.

As mentioned, this strand 20 is produced endlessly. The individual hoods 10 corresponding to FIG. 1 must then still be obtained from this strand 20.

Figure 3:
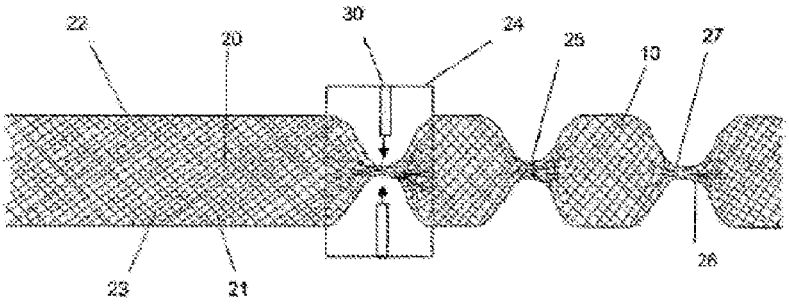
FIG. 3 shows schematically a series of nets or a strand for carrying out an embodiment of the method according to the invention.

A method for producing hoods 10 according to the invention is illustrated schematically in FIG. 3.

For producing hoods 10 in the form of hair nets, first a strand 20 is produced from a plurality of individual threads 21 by means of a Raschel machine or a knitting machine (not shown), which is presumed to be at the left edge of the schematic representation in FIG. 3. These individual threads preferably comprise polyamide and form a net which leaves the Raschel machine as a strand. The individual threads 21 cross many times and form between them meshes 23 of this net of strand 20. A strand 20 of this type is also called a "net series" by professionals.

The endlessly produced strand 20 is nearly flat in form and therefore possesses two longitudinal sides. An elastic edge thread 22 is continually fed into the meshes on each of these longitudinal sides. This elastic edge thread 22 preferably comprises a polyimide.

Strand 20 is continually produced and transported away, in fact at a constant rate, from left to right in the representation in FIG. 3.

Joining regions 24 are now introduced into this strand 20 at pre-determined and always equal distances. These joining regions 24 are indicated in FIG. 3 in such a way that they are formed by moving or pressing together strand 20 from both sides of strand 20, so that the two edge threads 22, which run along the longitudinal sides of strand 20, are brought together and lie next to one another.

The other individual threads 21 of the net of strand 20 also then lie close together and surrounded by the two elastic edge threads 22, wherein the exact positioning is of little significance. The elastic edge threads 22 are preferably clearly thicker and more distinctive than the individual threads 21.

The arrangement 30, which is indicated in FIG. 3, and which moves the two edge threads 22 together with the net of strand 20 at the pre-determined position, also melts or bonds the two edge threads 22 together with the other individual threads 21 at this position. For this purpose, an ultrasonic bonding device can be provided as arrangement 30 or in this arrangement 30; other suitable devices can also be used for melting or bonding the elastic edge threads 22.

In the indicated preferred version, this joining region 24 is additionally provided with a weakness 25. This weakness 25 can be a perforation and/or also a notched line or a differently shaped weakness line.

It can be seen in FIG. 3 that by the continuous further transport of strand 20, each largely uninfluenced region of strand 20 alternates with these joining regions 24 plus weaknesses 25.

Regions that would be usable as hoods 10 are then formed each time between two joining regions 25. A region which would form a first hood 10, whose end 26 is found in a joining region 24, can be recognized on the right. Directly on the other side of a weakness 25 of the same joining region 24 is then the beginning 27 of a second hood 10.

This second hood 10 then ends at another weakness 25 of the next joining region 24.

In this way, these regions can be used as hoods 10; one needs only to break joining regions 24 at the weaknesses 25. This is carried out, however, not in the manufacture of strand 20 with hoods 10, but rather after the manufacture, the strand 20 is suitably rolled up just outside at the right of the figure, either onto rolls or in an accordion arrangement. The entire arrangement made up of a plurality of hoods 10 is jointly transported unseparated, and directly prior to the use of a hood 10, an end user separates a first hood 10 from a second hood 10 at the joining region 24 to the second hood 10 via the weakness 25, and thus makes it available for use. An opening 14 is automatically formed and the sections of the elastic edge threads 22, which are bonded together at the joining regions 24 as mentioned, and which extend from one joining region 24 to the next joining region 24, together form the elastic edge threads 13 of FIG. 1, which run around the opening 14 also forming in this way. The hood 10 can be used at this point.

During transport, however, all hoods 10 can be handled together, unseparated, in order to facilitate transport.

List of Reference Characters

10 Hood
11 Meshes of a hood 10
12 Threads of the meshes
13 Elastic edge threads
14 Opening for donning
20 Strand
21 Individual threads of the net of the strand
22 Elastic edge threads of the net of the strand
23 Meshes of the net
24 Joining region
25 Weakness in the joining region
26 End of the first hood 10
27 Beginning of a second hood 10

What is claimed is:

1. A method of manufacturing and using a hood arrangement comprising the steps of:

providing a plurality of unseparated hoods that are formed into a chain at a manufacturing site;

constructing the plurality of unseparated hoods at the manufacturing site having two common elastic threads that pass through and which are guided in each of hoods through meshes in the peripheral region of the respective hoods;

constructing and arranging said plurality of unseparated hoods together to form said chain with every two adjacent hoods of the plurality of hoods being joined together at a joining region;

forming the joining region by a melting or bonding process of the two elastic threads with one another, which form surrounding edge threads, the joining region forming a weakness between every two adjacent hoods;

the step of constructing the plurality of unseparated hoods at the manufacturing site including all the hoods being unseparated and formed in one of a continuous roll and accordion arrangement;

providing a use site wherein the hoods are used by the application to the head of a subject; and separating the chain into individual hoods at the use site, different from the manufacturing site;

said separating step being between adjacent hoods at the joining region by means of a breaking at the joining region at the weakness.

2. The method according to claim 1, including providing the elastic threads constructed as covered threads.

3. The method according to claim 2, including providing the covered threads as comprised of a core thread of a material that has a melting point that is 10° C. or more, particularly 30° C. or more, higher than the material of the threads of the net forming the meshes and of the material of the threads used for the covering.

4. The method according to claim 1, including providing the elastic threads as a thermoplastically fixed, particularly spiral-shaped, coiled polyamide.

5. The method according to claim 1, including forming the weakness by a perforation.

6. The method according to claim 1, including forming the weakness by a constriction line crosswise to the longitudinal direction of the chain of a plurality of hoods.

7. The method according to claim 1, including forming the threads of the net from a polyamide or a polypropylene.

8. The method according to claim 1 including forming the joining region as a constricted joining region having a width substantially less than a hood width at the two common unjoined elastic threads, and forming the weakness at the constricted joining region.

9. The method according to claim 8 including forming the weakness by one of a perforation and a constriction line crosswise to the longitudinal direction of the chain.

* * * * *